US009129767B2

(12) United States Patent
Brignoli et al.

(10) Patent No.: US 9,129,767 B2
(45) Date of Patent: Sep. 8, 2015

(54) SWITCHING SYSTEM AND LOCKING DEVICE WITH A STATUS INDICATOR

(75) Inventors: Gustavo Brignoli, Bergamo (IT); Stefano Besana, Terno d'Isola (IT)

(73) Assignee: ABB S.P.A., Milan (IT)

( * ) Notice: Subject to any disclaimer, the term of this patent is extended or adjusted under 35 U.S.C. 154(b) by 143 days.

(21) Appl. No.: 13/529,598

(22) Filed: Jun. 21, 2012

(65) Prior Publication Data

US 2013/0001953 A1 Jan. 3, 2013

(30) Foreign Application Priority Data

Jun. 22, 2011 (EP) ..... 11171070

(51) Int. Cl.

| | |
|---|---|
| ***H01H 9/28*** | (2006.01) |
| ***H01H 71/02*** | (2006.01) |
| ***H01H 9/16*** | (2006.01) |
| ***H01H 71/04*** | (2006.01) |
| ***H01H 71/10*** | (2006.01) |

(52) U.S. Cl.

CPC ..... *H01H 71/025* (2013.01); *H01H 9/167* (2013.01); *H01H 9/281* (2013.01); *H01H 71/04* (2013.01); *H01H 71/1054* (2013.01); *H01H 2071/0292* (2013.01); *H01H 2071/042* (2013.01)

(58) Field of Classification Search

USPC ..... 200/50.1, 43.11, 43.12; 307/112; 335/34, 77, 113, 167, 168; 361/194

IPC ..... H02H 7/005; H01H 3/22,3/227, 9/20, H01H 9/26

See application file for complete search history.

(56) References Cited

U.S. PATENT DOCUMENTS

| | | | | |
|---|---|---|---|---|
| 5,357,394 | A * | 10/1994 | Piney | 361/72 |
| 5,477,016 | A | 12/1995 | Baginski et al. | |
| 6,307,167 | B1 | 10/2001 | Kajio et al. | |
| 6,448,521 | B1 * | 9/2002 | Castonguay et al. | 200/400 |
| 8,389,880 | B2 * | 3/2013 | Lee | 200/43.11 |
| 2003/0098221 | A1 | 5/2003 | Bhusri et al. | |
| 2014/0353133 | A1 * | 12/2014 | Roehrig et al. | 200/318 |

FOREIGN PATENT DOCUMENTS

| | | | |
|---|---|---|---|
| EP | 0883148 | A2 | 12/1998 |
| EP | 0977227 | A2 | 2/2000 |
| EP | 1744428 | A2 | 1/2007 |
| EP | 1870919 | A1 | 12/2007 |
| EP | 2256770 | A1 | 12/2012 |

* cited by examiner

*Primary Examiner* — Vanessa Girardi

(74) *Attorney, Agent, or Firm* — Buchanan Ingersoll & Rooney PC

(57) ABSTRACT

Exemplary embodiments are directed to a switching device for an electric circuit including at least one contact movable between a closed position in which it is coupled to a corresponding fixed contact and an open position in which it is spaced away from said corresponding fixed contact. The switching device including at least one locking device configured for being actuated between a rest configuration in which said at least one movable contact is free to move and an operative configuration in which it locks said at least one movable contact in the open position. The locking device is configured for outputting one or more electrical signals which are indicative of at least one of the rest configuration, the operative configuration, and an under actuation condition wherein the locking device itself is moving between said rest and operative configurations.

20 Claims, 10 Drawing Sheets

SWITCHING SYSTEM AND LOCKING DEVICE WITH A STATUS INDICATOR

RELATED APPLICATIONS

This application claims priority under 35 U.S.C. §119 to European Patent Application No. 11171070.3 filed in Europe on Jun. 22, 2011, the entire content of which is hereby incorporated by reference in its entirety.

FIELD

The present disclosure relates to a switching device such as a switching device for an electric circuit, in particular for a low voltage or a medium voltage electric circuit, having an improved signaling of its locked status and/or unlocked status.

BACKGROUND INFORMATION

Known switching devices used in low voltage and medium voltage electric circuits, such as circuit breakers, disconnectors and contactors, are devices designed to allow the correct operation of specific parts of the electric circuits in which they are installed, and of the associated electric loads.

For the purpose of the present disclosure the term "low voltage" is referred to power applications with operating voltages up to 1000V AC/1500V DC, and the term "medium voltage" is referred to applications in the range from 1 kV up to some tens of kV, e.g. 50 kV.

Known switching devices can include a case housing one or more electric poles, each one having at least one movable contact and a corresponding fixed contact.

A driving mechanism causes the movement of the movable contacts between a first closed position in which they are coupled to the corresponding fixed contacts and a second open position in which they are spaced away from the corresponding fixed contacts.

The operation of the driving mechanism on the movable contacts is generally carried out through a main shaft which is operatively connected to the movable contacts; a kinematic chain of the driving mechanism causes the desired movement of the main shaft for opening or closing the switching device.

The driving mechanism may be manually actuated by an operator for causing the opening or the closure of the switching device, or the driving mechanism may be actuated by one or more protection devices, in the event that electrical faults or failures occur and the opening of the switching device is therefore specified, for example, when a short circuit or an electric overload occurs.

Further, the driving mechanism may be actuated for causing the opening or the closure of the switching device by one or more accessories, such as for example, a motor operated equipment (MOE) or coil actuators.

Various types of known locking devices can be operatively connected to one or more parts of the kinematic chain so as to indirectly act, through such kinematic chain, on the rotating shaft to lock the movable contacts in their open position, therefore preventing the re-closure of the locked open switching device. In this way, an operator may operate in a safe way on one or more parts of the electric circuit in which the switching device is installed.

Known locking devices can be configured only for visually signaling their actuation and therefore the locked status of the open switching device, for example, through the positioning of one or more of their components. Only operators close to the switching device may visually check such locked status.

Such a condition can be particularly disadvantageous when the switching device is located in a non-easy accessible location, or many switching devices are located at different distant locations in the electric circuit in which they are installed. For example, in a wind power generation plant switching devices are installed at the base or on the top of wind towers.

Therefore, although known solutions perform in a rather satisfying way, there is still reason and desire for further improvements.

SUMMARY

An exemplary switching device for an electric circuit is disclosed, comprising: at least one contact movable between a closed position in which it is coupled to a corresponding fixed contact and an open position in which it is spaced away from said corresponding fixed contact; and at least one locking device configured for being actuated between a rest configuration in which said at least one movable contact is free to move and an operative configuration in which it locks said at least one movable contact in the open position, wherein the at least one locking device is configured for outputting one or more electrical signals which are indicative of at least one of the rest configuration, the operative configuration, and an under actuation condition wherein the locking device itself is moving between said rest and operative configurations.

An exemplary power distribution system comprising: at least one switching device for an electric circuit is disclosed, comprising: at least one contact movable between a closed position in which it is coupled to a corresponding fixed contact and an open position in which it is spaced away from said corresponding fixed contact; and at least one locking device configured for being actuated between a rest configuration in which said at least one movable contact is free to move and an operative configuration in which it locks said at least one movable contact in the open position, wherein the at least one locking device is configured for outputting one or more electrical signals which are indicative of at least one of the rest configuration, the operative configuration, and an under actuation condition wherein the locking device itself is moving between said rest and operative configurations; and at least one of a monitor and control station located remote to said at least one switching device, wherein said at least one locking device of the switching device is connected to at least one of said monitor and control station so as to transmit to at least one of the monitor and control station said one or more electrical signals.

BRIEF DESCRIPTION OF THE DRAWINGS

Further characteristics and advantages of the disclosure will be more apparent from the description of exemplary, but non-exclusive, embodiments of the switching device according to the present disclosure, illustrated in the accompanying drawings, wherein.

DETAILED DESCRIPTION

Figure 1:
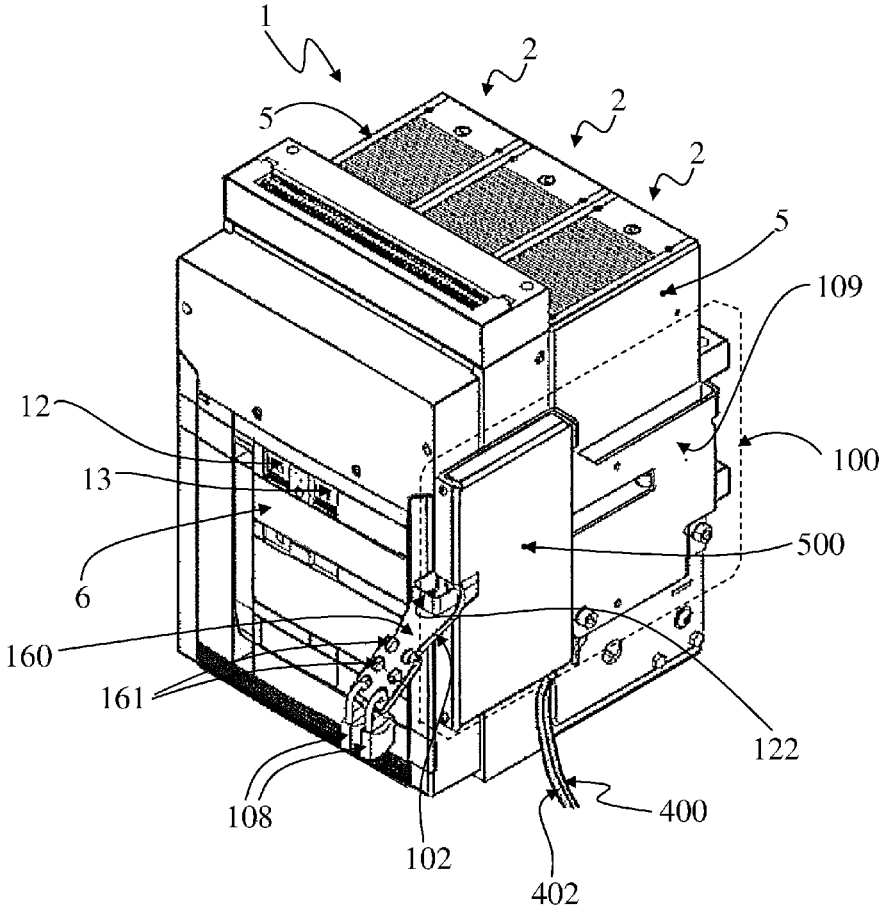
FIG. 1 shows a switching device with a locking device coupled to one of its flanks in accordance with an exemplary embodiment of the present disclosure.

Exemplary embodiments of the present disclosure improve known devices by providing a switching device for an electric circuit, including at least one contact movable between a closed position in which it is coupled to a corresponding fixed contact and an open position in which it is spaced away from said corresponding fixed contact. The switching device includes at least one locking device configured for being actuated between a rest configuration in which said at least one movable contact is free to move and an operative configuration in which it locks said at least one movable contact in the open position. The locking device can be configured for outputting one or more electrical signals which are indicative of at least one of the rest configuration, the operative configuration, and an under actuation condition wherein the locking device itself is moving between said rest and operative configurations.

In the present disclosure, the exemplary switching devices are described by making particular reference to its embodiment as an open air circuit breaker (ACB); such exemplary embodiments are to be understood only as illustrative and non-limiting examples since the principles and technical solutions introduced in the following description can be applied to other types of circuit breakers, such as for example, molded case circuit breakers (MCCBs), or to other types of switching devices, such as for example, disconnectors or contactors.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

Figure 2:
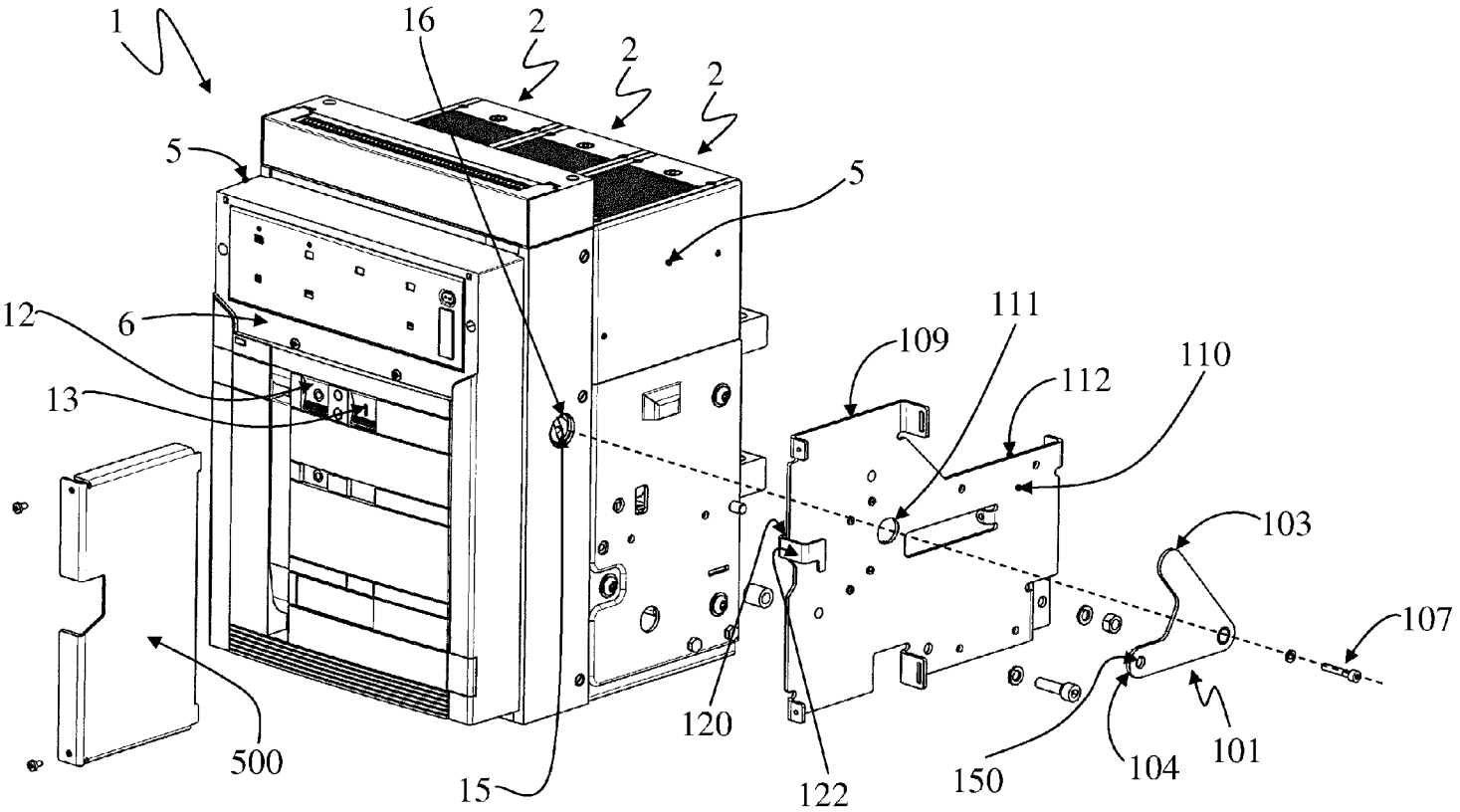
FIG. 2 is an exploded view showing the components of the locking device of FIG. 1 in accordance with an exemplary embodiment of the present disclosure.

FIG. 1 shows a switching device with a locking device coupled to one of its flanks in accordance with an exemplary embodiment of the present disclosure. FIG. 1 illustrates an exemplary non-limiting embodiment of a circuit breaker and of a related locking device, globally indicated throughout the following description by reference numbers 1 and 100, respectively. FIG. 2 is an exploded view showing the components of the locking device of FIG. 1 in accordance with an exemplary embodiment of the present disclosure.

FIG. 1 shows an exemplary non-limiting embodiment of an open air circuit breaker 1 having a case housing three electric poles 2, or phases 2; the principles and technical solutions that will be introduced in the following description are intended to be applicable also to an exemplary circuit breaker 1 with a number of phases 2 different from the illustrated one, such as for example, a monophase circuit breaker 1, or a circuit breaker 1 with two or four phases 2.

Figure 9:
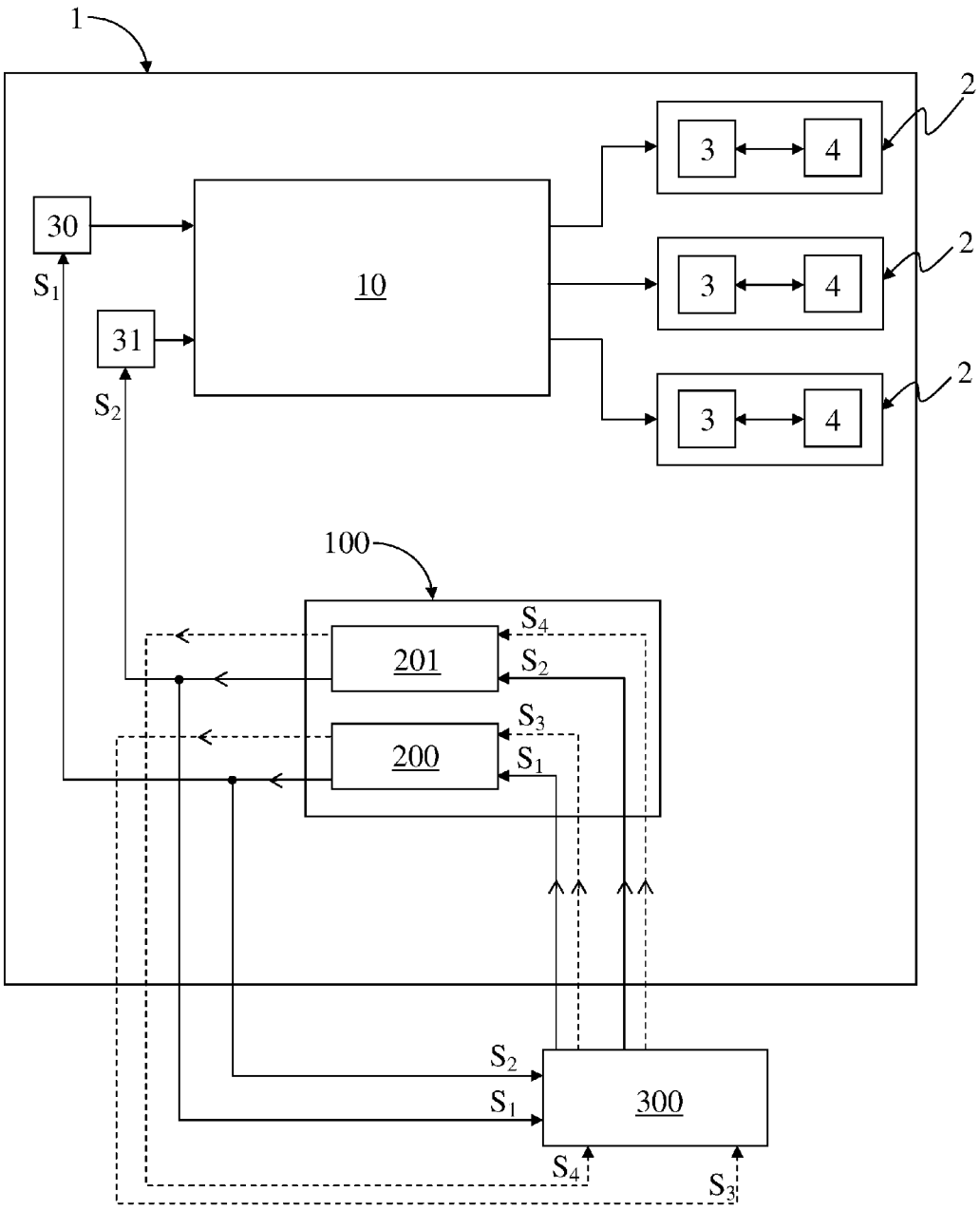
FIG. 9 is a block diagram schematically representing a switching device in accordance with an exemplary embodiment of the present disclosure.

Each phase 2 of the circuit breaker 1 includes (e.g., comprises) at least one movable contact 3 and a corresponding fixed contact 4 which are schematically depicted in the block diagram of FIG. 9. The movable contacts 3 are actuated by an associated driving mechanism 10 of the circuit breaker 1 schematically depicted in the block diagram of FIG. 9 so as to move between a first position, or closed position, in which they are coupled to the corresponding fixed contacts 4 closed or "ON" circuit breaker 1, and a second position, or open position, in which they are spaced away from the corresponding fixed contacts 4, so as to interrupt the current flowing into the phases 2 open or "OFF" circuit breaker 1.

The driving mechanism 10 is of a generally known type, and therefore only its elements useful for the understanding of the following description are herein shortly disclosed. The driving mechanism 10 includes a main rotating shaft 11 whose ends are operatively coupled to the flanks 5 of the circuit breaker 1, so as the rotating shaft 11 is able to rotate about a rotation axis 20 (see FIG. 2). The rotating shaft 11 is operatively connected to the movable contacts 3 so as to cause with its rotation about the axis 20 the movement of such contacts 3 from the closed position to the open position opening operation of the circuit breaker 1 or from the open position to the closed position closure of the circuit breaker 1. For example, the rotating shaft 11 can be operatively connected to the movable contacts 3 by means of contact-holding members; alternatively, the contacts 3 may by directly mounted in corresponding seats defined on the rotating shaft 11, so as to configure with the rotating shaft 11 itself a movable equipment.

The driving mechanism 10 includes a kinematic chain which is operatively connected to the rotating shaft 11 and which is suitable for transmitting the force for causing the rotation of the rotating shaft 11 about the axis 20, when it is actuated.

For example, one or more protection devices of the circuit breaker 1, such as one or more relays, are suitable for causing the actuation of the kinematic chain to drive the rotation of the shaft 11 in order to open the circuit breaker 1, upon the occurrence of electric faults or failures.

The kinematic chain may also be manually actuated by an operator; for example, an opening button 12 "O" or "OFF" and a closure button 13 "I" or "ON" are accessible to the operator on the front mask 6 of the circuit breaker 1 depicted in FIGS. 1-2, and are operatively associated to the kinematic chain to cause the opening and the closure of the circuit breaker 1, respectively, when they are pushed.

Further, the circuit breaker 1 may comprise one or more accessories 30, 31, or actuators 30, 31, which are operatively connected to the driving mechanism 10 and are suitable for causing with their intervention the closure and/or the opening of the circuit breaker 1.

In particular, the closure actuators 30 are configured for being driven to act on one or more corresponding parts of the driving mechanism 10 causing the rotation of the rotating shaft 11 about the axis 20 with the consequent movement of the movable contacts 3 from the open position to the closed position. Non-limiting examples of closure actuators 30 suitable for being used to close the circuit breaker 1 are a motor operated equipment (MOE) or a shunt closing relay.

The opening actuators 31 can be configured for being driven to act on one or more corresponding parts of the driving mechanism 10 causing the rotation of the rotating shaft 11 about the axis 20 with the consequent movement of the movable contacts 3 from the closed position to the open position.

For example, the circuit breaker 1 schematically depicted in FIG. 9 includes at least: a motor operated equipment 30 hereinafter indicated as "MOE 30" which is suitable for causing the opening or the closure of the circuit breaker 1; and an opening coil actuator 31, in particular an undervoltage release actuator 31 hereinafter indicated as "UVR 31" which is an actuator configured for intervening on the corresponding parts of the driving mechanism 10 to cause the opening of the circuit breaker 1 when the power supplied to it falls below a predetermined threshold of intervention.

Both the MOE 30 and the UVR 31 are actuating accessories that are well known in the art, and therefore they are not described in more detail therein.

According to an exemplary embodiment of the present disclosure, the locking device 100 can be configured to be actuated between a rest configuration in which the movable contacts are free to move and an operative configuration in which it locks the movable contacts in the open position. In practice, the locking device 100 in the operative configuration locks the open circuit breaker 1 and prevents the closure thereof which may be attempted, for example, by a manual operation or by one or more closure actuators, such as the MOE 30. In this way the safety of the operators operating on the electric circuit parts disconnected from the power line through the opening of the circuit breaker 1 is guaranteed.

In particular, the locking device 100 is operatively connected to one or more parts of the driving mechanism 10 so as to lock the movable contacts 3 in their closed positions when the locking device 100 itself is in its operative configuration. According to the exemplary embodiments shown, the locking device 100 advantageously has one or more parts coupled to the rotating shaft 11 and it is configured for directly acting on such rotating shaft 11 and locking the movable contacts 3 in the open position when it is in the operative configuration.

Therefore, the locking device 100 guarantees a high reliability of the locking operation of the circuit breaker 1, because it directly acts on the rotating shaft 11, without the intervention or other mechanical parts, such as one or more components of the kinematic chain for driving the rotating shaft 11.

According to the exemplary embodiments of FIGS. 1-8, the locking device 100 includes a first movable element 101, which can be made of metallic material, such as for example, a metal sheet, which is operatively coupled to one or more parts of the driving mechanism 10 so as to be movable between a first position corresponding to the closed position of the movable contacts 3 closed circuit breaker 1, and a second position corresponding to the open position of the movable contacts open circuit breaker 1. In particular, in the exemplary embodiments shown, the first movable element 101 can be operatively coupled to an end 15 of the rotating shaft 11, which is accessible from the outside of the case of the circuit breaker 1 through an opening 16 defined in the corresponding flank 5 of the circuit breaker 1.

The locking device 100 further includes blocking means 102 configured for operatively interacting with the first movable element 101 in the second position, so as to block the first movable element 101 in the second position and to lock the movable contacts 3 in the open position.

In practice, the blocking means 102 are coupled in a removable way to the first movable element 101 and constrains the first movable element 101 to a fixed support, which may be constituted by one or more parts of the locking device 100 and/or by one or more parts of the circuit breaker 1, such as the case of the circuit breaker 1. The constrained first movable element 101 constrains in turn the movable contacts 3 in the open position.

As shown in the exemplary embodiments of FIGS. 2-3 and 7-8, the first movable element 101 includes a lever 101 (shown by dashed lines in FIGS. 7-8) with at least a first arm 103, a second arm 104 and a fulcrum portion 105; a pin 106 leans forward transversally from the fulcrum portion 105 and includes a protrusion 18 defined at its end.

Figure 3:
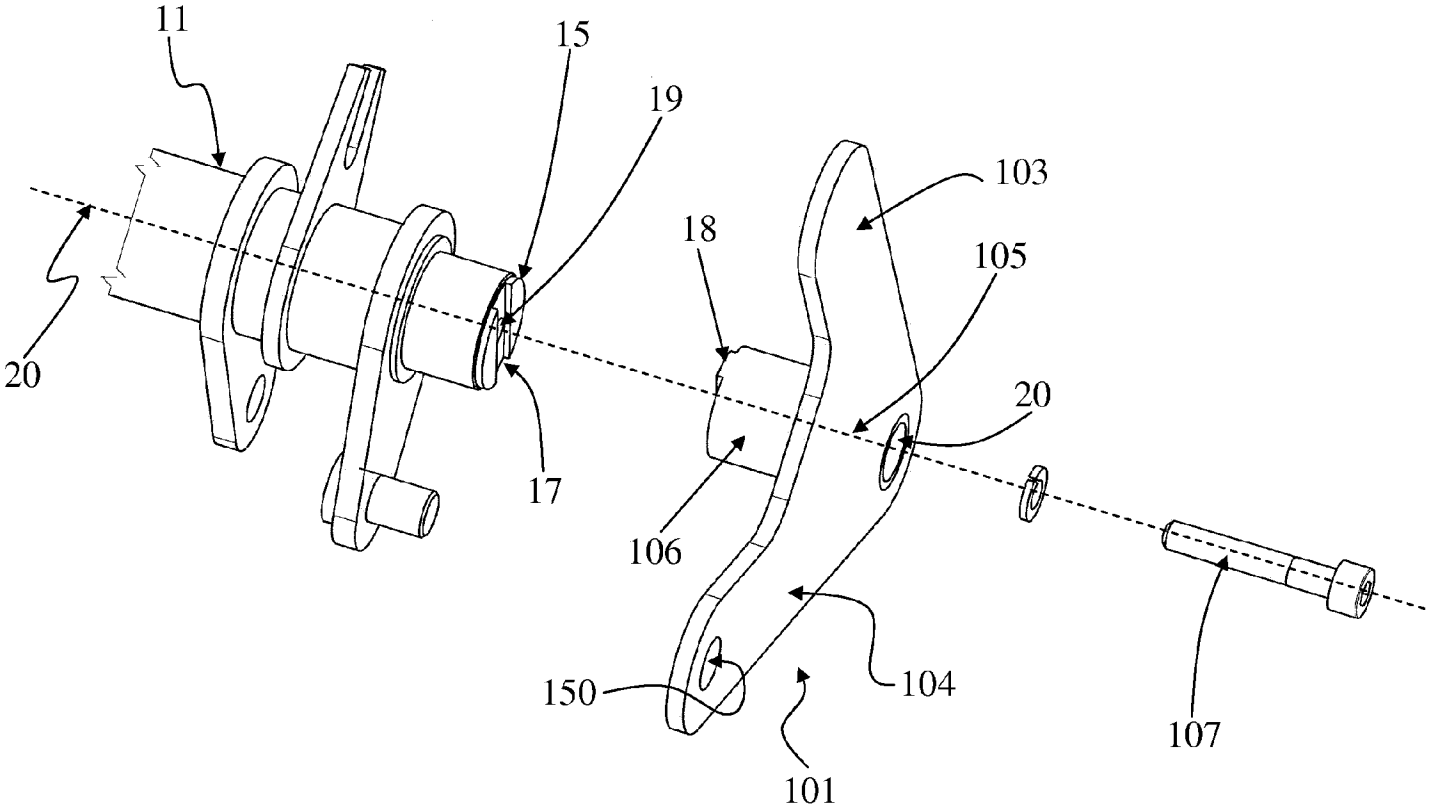
FIG. 3 shows the coupling between one element of a locking device with a corresponding portion of the main rotating shaft of an associated switching device in accordance with an exemplary embodiment of the present disclosure.

FIG. 3 shows the coupling between one element of a locking device with a corresponding portion of the main rotating shaft of an associated switching device in accordance with an exemplary embodiment of the present disclosure. As shown in detail in FIG. 3, the lever 101 is mechanically coupled to the end 15 of the rotating shaft 11, which is accessible through the opening 16 defined in corresponding the flank 5 of the circuit breaker 1 see FIG. 2). In particular, the end 15 of the rotating shaft 11 includes a slot 17 defined for mating the protrusion 18 of the pin 106; a fixing screw 107 is inserted in corresponding holes 19 and 20 defined through the end 15 and through the pin 106, respectively, so as to fix the lever 101 to the rotating shaft 11.

Therefore, the lever 101 is fastened with the rotating shaft 11, meaning that the rotating shaft 11 and the coupled lever 101 are free to rotate about the axis 20, when the lever 11 is not blocked by the blocking means 102 locking device 100 in the rest configuration; the rotation of the rotating shaft 11 and the coupled lever 101 about the axis 20 is instead blocked when the lever 101 is blocked by the blocking means 102 locking device 100 in the operative configuration.

The exemplary locking device 100 according to the illustrated embodiments includes a mounting plate 109, which can be made of metallic material, such as for example, metal sheet, which is coupled, e.g., fixed, to the flank 5 of the circuit breaker 1, from which the end 15 of the rotating shaft 11 is accessible through the opening 16 (see FIG. 2).

The mounting plate 109 includes first and second opposite faces 110, 112, wherein the second face 112 faces the corresponding flank 5 of the circuit breaker 1. The lever 101 is mounted in a movable way on the first surface 110; in particular, an opening 111 is defined across the mounting plate 109, between the first and second faces 110, 112, and allows the insertion therethrough of the pin 106 for coupling the lever 101 with the end 15 of the rotating shaft 11.

The locking device 100 according to an exemplary embodiment of the present disclosure includes a second movable element 120, which can be made of metallic material, such as for example, metal sheet, which is movable between a rest position and an actuated position, when actuated by an operator.

The second movable element 120 can be configured to prevent the blocking of the first movable element 101 by the blocking means 102 when it is in the rest position, and to enable the blocking of the first movable element 101 by the blocking means 102 when it is in the actuated position.

Hence, the displacement of the movable element 120 from the rest position to the pulled position causes the actuation of the locking device 100 for moving, or changing, between the rest configuration and the operative configuration in which the blocking means 102 are coupled to the first movable element 101.

For example, at least a first through hole 150 and a second through hole 151 are defined across the first movable element 101 and across the second movable element 120, respectively, wherein the first and second movable elements 101, 120 are configured so as the first and second through holes 150, 151 are aligned each other for the removable insertion therethrough of at least a portion of the blocking means 102 when the first movable element 101 is in the second position and the second movable element 120 is in the actuated position.

Figure 4:
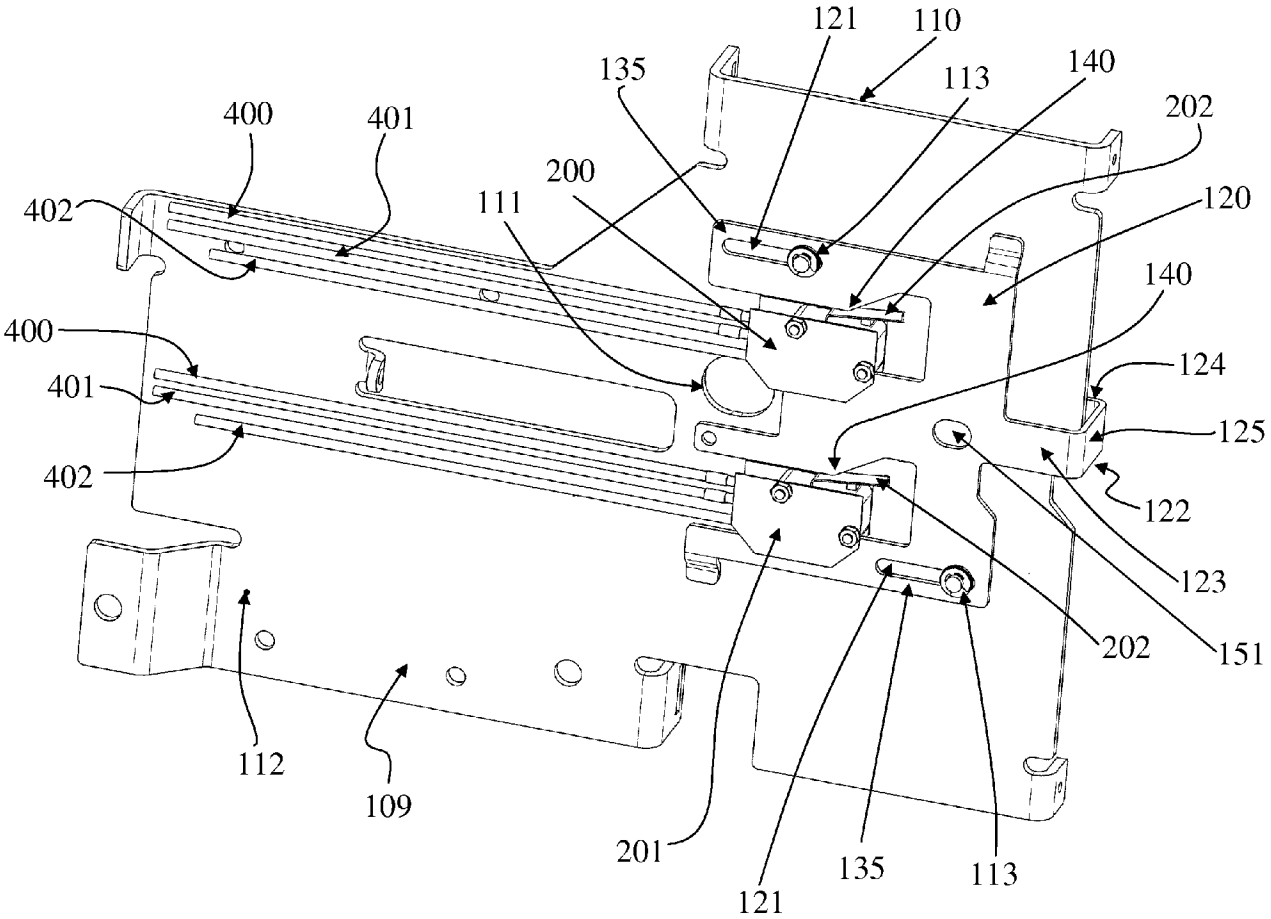
FIG. 4 is a perspective view of some parts of a locking device in a rest configuration in accordance with an exemplary embodiment of the present disclosure.
Figure 5:
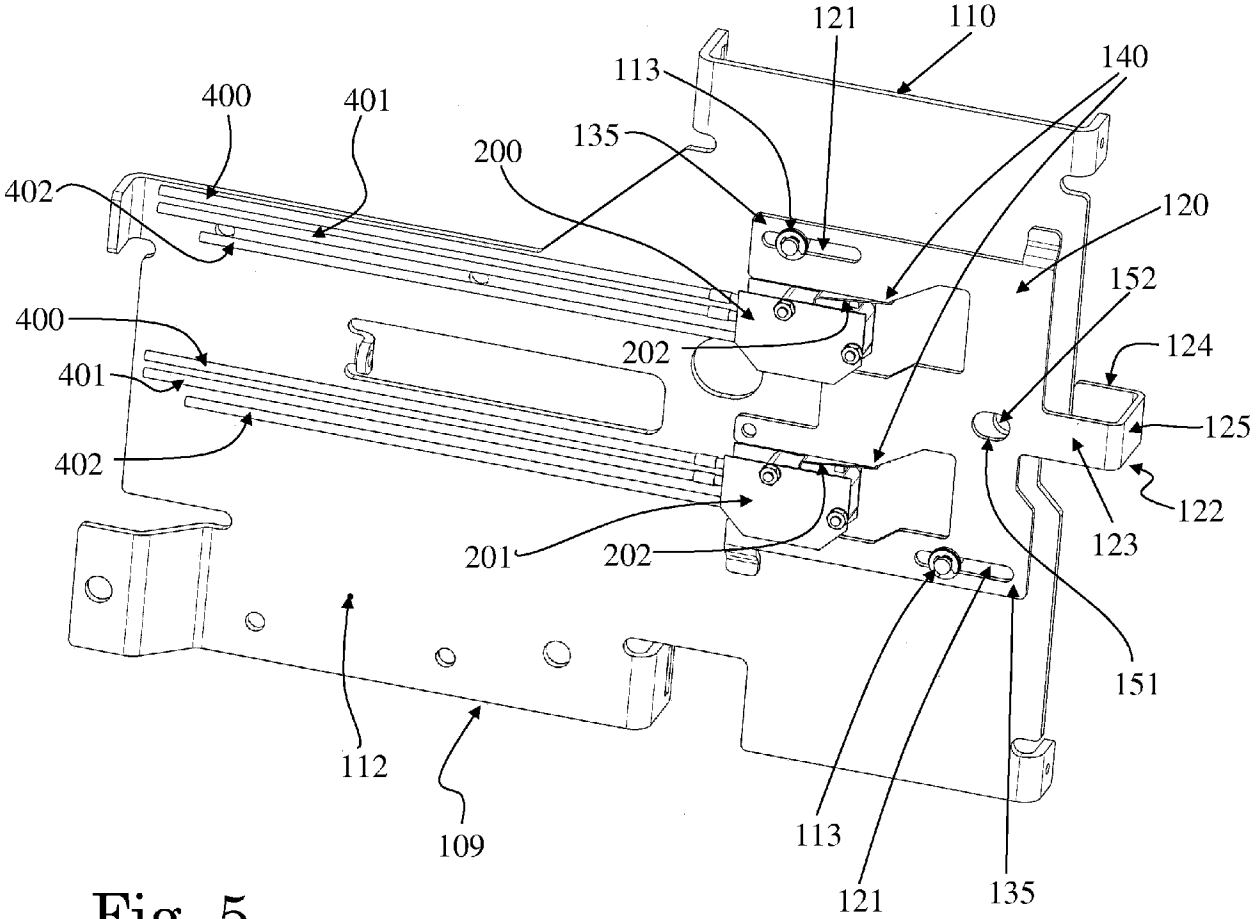
FIG. 5 is a perspective view of the locking device shown in FIG. 4, when such locking device is under actuation in accordance with an exemplary embodiment of the present disclosure.
Figure 6:
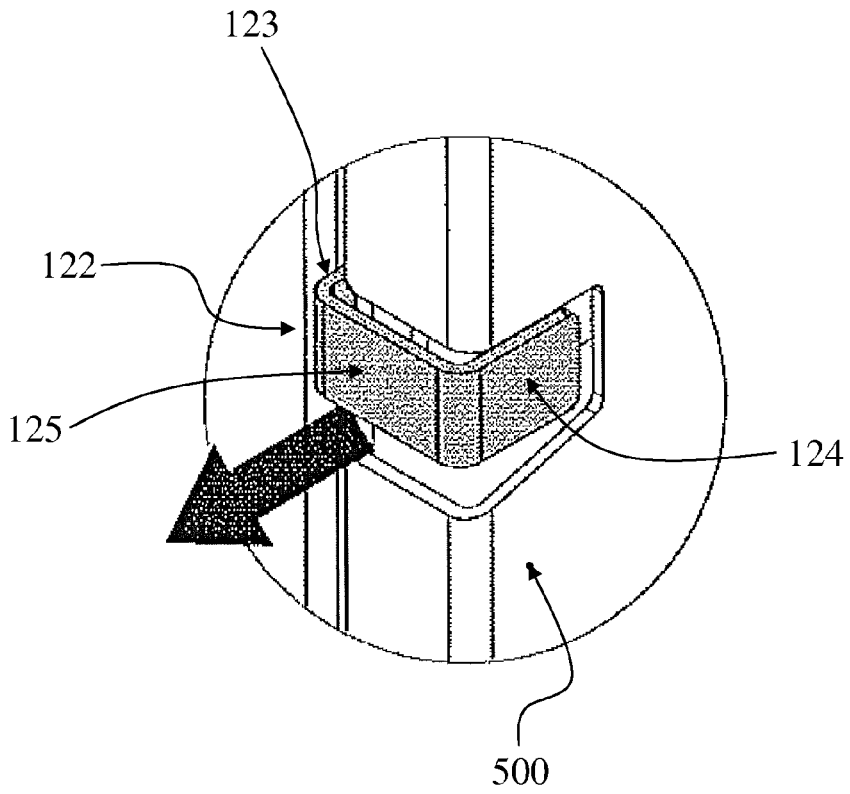
FIG. 6 shows a detail of the locking device in FIG. 1 in accordance with an exemplary embodiment of the present disclosure.
Figure 7:
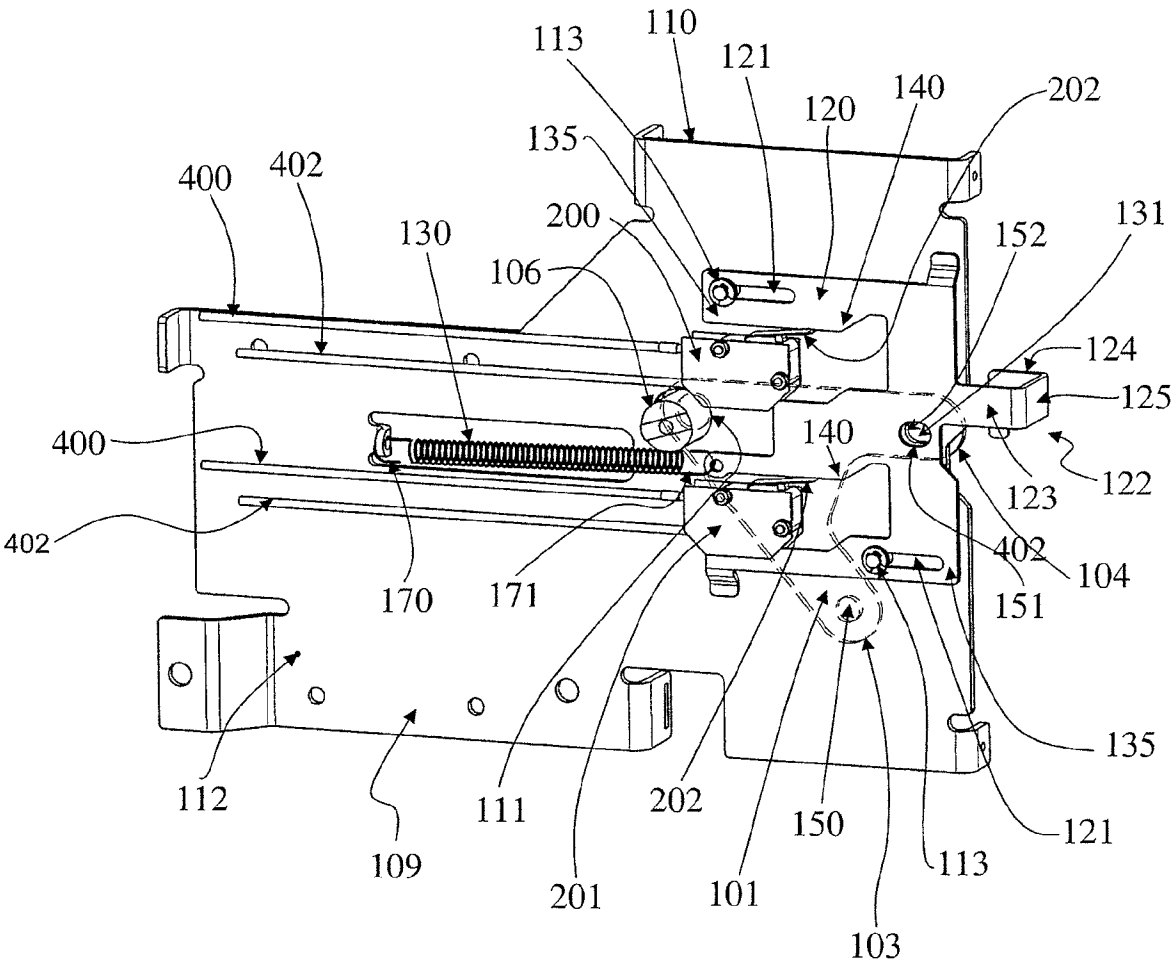
FIG. 7 is a perspective view of some parts of a locking device corresponding to a closed status of the associated switching device in accordance with an exemplary embodiment of the present disclosure.
Figure 8:
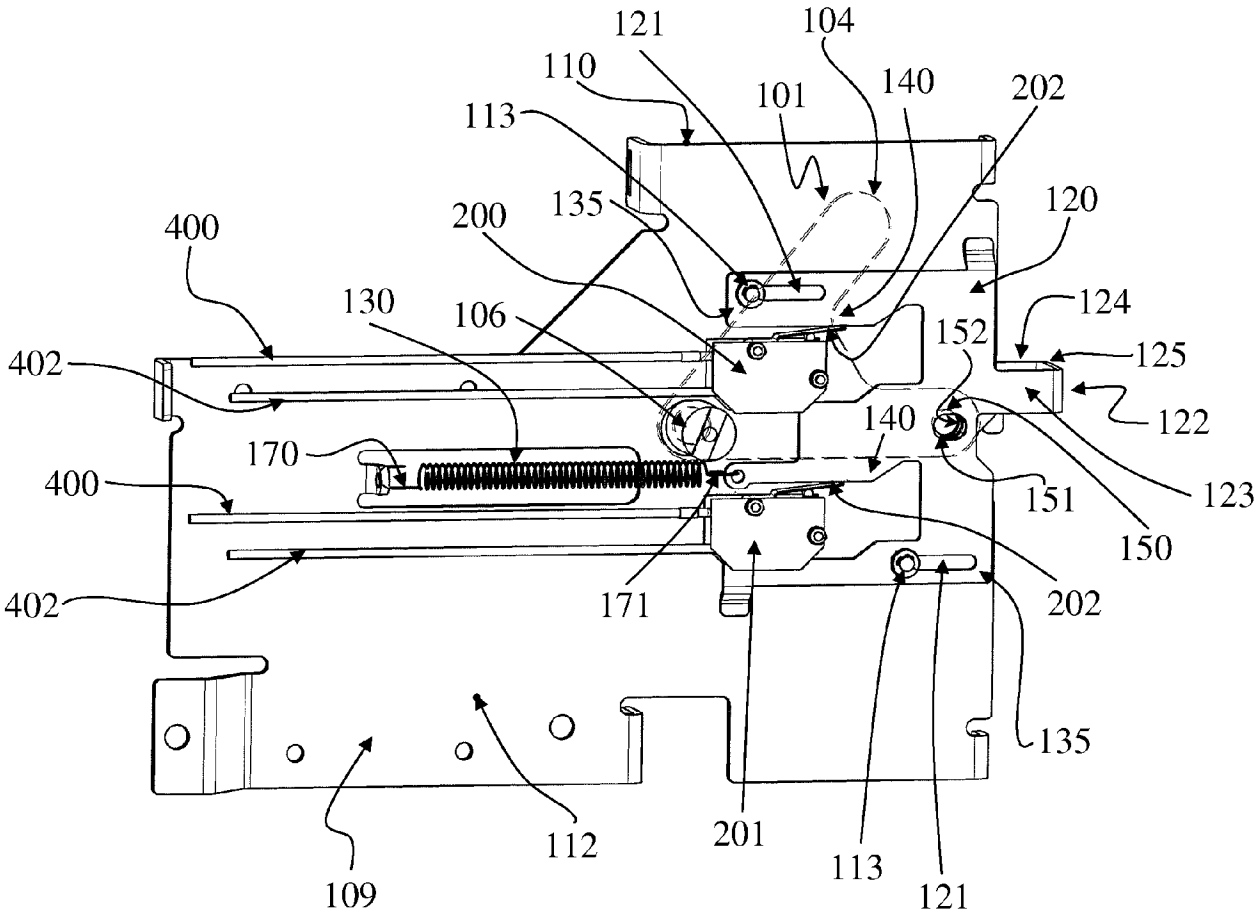
FIG. 8 is a perspective view of the locking device shown in FIG. 7, corresponding to an open status of the associated switching device in accordance with an exemplary embodiment of the present disclosure.

According to the exemplary embodiments of FIGS. 1-8, the second movable element 120 is suitable for sliding between the rest position (see, for example, FIG. 4) and the actuated position, or pulled position (see, for example, FIG. 5 or FIGS. 7-8). The sliding element 120 is mounted in a movable way on the second surface 112 of the mounting plate 109, so as the mounting plate 109 is interposed between the sliding element 120 and the lever 101; the sliding element 120 includes, for example, two slots 121 defined at two opposite ends 135 of such sliding element 120 and having their edge surfaces which slid during the movement of the sliding element 120 onto a corresponding fixed pin 113 leaning forward from the second face 112 of the mounting plate 109.

FIG. 6 shows a detail of the locking device in FIG. 1 in accordance with an exemplary embodiment of the present disclosure. The locking device 100 includes at least a biasing spring 130 shown, for example, in FIGS. 7-8 having a first end 170 hooked to the mounting plate 109 and an opposed second end 171 hooked to the sliding element 120, so as to cause the return of the sliding element 120 from the pulled to the rest position.

According to the exemplary embodiments illustrated, the first through hole 150 is defined across the second arm 104 of the lever 101, and the second through hole 151 is defined across the sliding element 120. In particular, the first through hole 150 is defined across the second arm 104 so as to be aligned with the second through hole 152 of the sliding element 120 in the pulled position when the lever 101 is in the second position corresponding to the open circuit breaker 1 (see, for example, FIG. 8).

FIG. 7 is a perspective view of some parts of a locking device corresponding to a closed status of the associated switching device in accordance with an exemplary embodiment of the present disclosure. The first arm 103 of the lever 101 includes a covering portion 131 which is suitable for covering the second through hole 151 of the sliding element 120 in the pulled position when the lever 101 is in the first position corresponding to the closed circuit breaker 1 (see, for example, FIG. 7).

Further, a third through hole 152 is defined across the mounting plate 109, between the first and second faces 110, 112, in such a way to be aligned with the first and second through holes 150, 151, when the lever 101 is in the second position and the sliding element 120 is in the pulled position.

When the circuit breaker 1 is open and the sliding element 120 has been pulled by an operator, at least a portion of the blocking means 102 can be inserted in a removable way through the overall hole defined by the series of the aligned first, second and third through holes 150, 151, 152. For example, a padlock 108 may be coupled to above mentioned overall hole so as the lever 101 in the second position is constrained to the structure of the locking device 100, in particular to the mounting plate 109, which in turn is fixed to the case of the circuit breaker 1; an attempt of re-closure of the circuit breaker 1 fails because the rotating shaft 11 is fastened to the constrained lever 101.

In the exemplary embodiment illustrated in FIG. 1, the blocking means 102 advantageously includes a crimp-configured portion 160 having an end inserted through the overall hole defined by the aligned through holes 150, 151, 152; the portion 160 further includes a plurality of openings 161 each coupled to a corresponding padlock 108. The padlocks 108 lock the crimp-configured portion 160 inserted into the aligned through holes 150, 151, 152, blocking the lever 101 in the second position and locking the open circuit breaker 1.

The keys associated to the padlocks 108 can be assigned each to a corresponding operator, and the open circuit breaker 1 can be unlocked by removing the blocking means 102 from the corresponding aligned through holes 150, 151, 152 only by means of the intervention of all the operators, therefore increasing the security of the electric circuit in which the circuit breaker 1 is installed.

According to the exemplary embodiments of the present disclosure, the sliding element 120 may have a shaped portion 122 which, when the sliding element 120 is in the rest position, is suitable for covering the portion 131 of the first arm 103 when the lever 101 is in the first position or for covering the first through hole 150 of the second arm 104 when the lever 101 is in the second position.

The shaped portion 122 includes, for example, a first section 123 and a second section 124 connected transversally by a third section 125; when the sliding element 120 is in the rest position, the third section 125 covers a corresponding portion of the edge of the mounting plate 109 which links the first and second faces 110, 112. Hence, the first section 122 and the second section 124 face to the first face 110 and the second face 112, respectively, when the sliding element 120 is in the rest position (see, for example, FIGS. 4 and 6). In particular, at least a portion of the second section 124 covers the covering portion 131 of the lever 101 in the first position, or the first through hole 150 of the lever 101 in the second position.

In an exemplary embodiment of the present disclosure, the locking device 100 includes a cover 500, made, for example, of metallic material, which covers one or more parts of at least the first movable element 101.

In the embodiment illustrated, for example, in FIG. 1, the cover 500 is coupled to the mounting plate 109 so as to cover the parts of the lever 101 in the first position or in the second position which are not covered by the above described shaped portion 122 of the sliding elements 120 in the rest position. Therefore, the lever 101, in particular its fulcrum portion 105 coupled to the end 15 of the rotating shaft 11, is not directly accessible by an operator from the outside of the locking device 100, thus guaranteeing an improved safety.

The exemplary locking device 100 according to the present disclosure is configured for outputting one or more electrical signals S1, S2 which are indicative of at least one of the rest configuration, the operative configuration, and an under actuation condition of the locking device 100 itself, i.e. the locking device 100 is moving, or changing, between such rest and operative configurations.

According to the exemplary embodiments of FIGS. 4-5 and 7-9, the locking device 100 includes one or more signaling devices 200, 201 each configured for receiving in input a first electrical signal S1, S2 provided from the outside of the locking device 100, for example an electrical signal S1, S2 sent from a monitor and/or control location 300 for the circuit breaker 1 (see FIG. 9). Such signaling devices 200, 201 are configured for outputting the received first electrical S1, S2 when they are operated.

The signaling devices 200, 201 can be configured for operatively interacting with one or more parts of the locking device 100 so as to be operated by such one or more parts when the locking device 100 is under actuation and/or in the operative configuration.

According to the exemplary embodiments of FIGS. 4-5 and 7-8, the signaling devices 200, 201 are configured for operatively interacting with the second movable element 120 of the locking device 100 so as to start being operated by such second movable element 120 during its movement from the rest position to the actuated position locking device 100 under actuation condition, and to be kept operated while the second movable element 120 is locked in the operated position by the blocking means 102 locking device 100 in the operative configuration.

In another exemplary embodiment, the signaling devices 200, 201 can be configured for operatively interacting with one or more parts of the locking device 100, such as the second movable element 120, so as to be operated by such one or more parts only when the locking device 100 is under actuation or only when the locking device 100 is in the rest configuration.

According to an exemplary embodiment disclosed herein, the signaling devices 200, 201 may be configured for not outputting any electrical signal when they are not operated for outputting the received first electrical signal S1, S2, therefore acting as simple "one way" switches.

According to another exemplary embodiment of the present disclosure, at least one of the signaling devices 200, 201 of the locking device 100 may be further configured for receiving in input a second electrical signal S3, S4 which is provided from the outside of the locking device 100 and which is different with respect to the first electrical signal S1, S2; such signaling device 200, 201 is configured for outputting the second electrical signal S3, S4 when it is not operated for outputting the received first electrical signal S1, S2. Therefore, the signaling device 200, 201 according to the second embodiment is configured for acting as a "two way" switch which outputs the first received electrical signal S1, S2 or the second received electrical signal S3, S4, so as to electrically signaling the actuation condition and/or the operative configuration of the locking device 100, and also the rest configuration of such locking device 100.

The exemplary locking device 100 according to the present disclosure may be operatively connected to one or more of the closure actuators 30 of the circuit breaker 1, so as to automatically disable such one or more closure actuators 30, 31 by means of at least one outputted electrical signal S1 which is indicative of the under actuation condition and/or the operative configuration of the locking device 100. For example, for each closure actuator 30 a corresponding signaling device 200 is provided in the locking device 100; such signaling device 200 is operatively connected to the corresponding closure actuator 30 to automatically disable it by means of the outputted first electrical signal S1 which is indicative of the under actuation condition and/or the operative configuration of the locking device 100.

In this way, re-closure attempts of the locked open circuit breaker 1 by the closure actuators 30 are prevented, which may cause damages of one or more parts of the circuit breaker 1 and/or the locking device 100 and/or the closure actuators 30 itself.

An operator may forget to check the open or closed status of the circuit breaker 1 before actuating the locking device 100; therefore the operator may dangerously try to lock the movable contacts 3 through the locking device 100 when the circuit breaker 1 is closed. Advantageously, the locking device 100 according to the present disclosure may be operatively connected to one or more opening actuators 31 of the circuit breaker 1, to automatically cause the intervention of such opening actuators 31 for opening of the circuit breaker 1. The intervention of the opening actuators 31 is caused by at least one electrical signal S2 outputted by the locking device 100 and indicative of the under actuation condition and/or the operative configuration of the locking device 100 itself. For example, for each opening actuator 31 a corresponding signaling device 201 is provide in the locking device 100; such signaling device 201 is operatively connected to the corresponding opening actuator 31 to automatically cause the intervention of the opening actuator 31 for opening the circuit breaker 1 by means of the outputted first electrical signal S2 which is indicative of the under actuation condition and/or the operative configuration of the locking device 100.

In this way, the opening of the circuit breaker 1 during the actuation of the locking device 100 is guaranteed, therefore improving the safety of the operators.

In the exemplary embodiments of FIGS. 4-5 and 7-9, the locking device 100 includes a first signaling device 200 or first micro-switch 200 and a second signaling device 201 or second micro-switch 201 which are mounted on the second face 112 of the mounting plate 109.

As shown schematically in FIG. 9, the first signaling device 200 and the second signaling device 201 receive in input the electrical signal S1 and the electrical signal S2, respectively, through respective cables or wires 400. For example, the electrical signals S1 and S2 are sent to the corresponding first and second signaling devices 200, 201 from the schematically illustrated monitor and/or control location 300.

Each of the first and second signaling devices 200, 201 comprises a lever 202 which causes the outputting of the respective electrical signal S1 or S2 received in input, when the levers 202 are actuated.

In the exemplary embodiment of FIGS. 7-8, the first and second signaling devices 200, 201 are "one way" switches which do not output any electrical signal when the lever 202 is not actuated; in the exemplary embodiment of FIGS. 4-5, the first and second signaling devices 200, 201 are "two way" switches which output the electrical signal S3 and the electrical signal S4, respectively, when the levers 202 are not actuated; as schematically shown in FIG. 9, the first and second signaling devices 200, 201 receive in input the respective electrical signals S3 and S4 from the monitor and/or control location 300 through cables 401.

The sliding element 120 of the locking device 100 comprises portions 140 shaped for starting to actuate the levers 202 of the first and second signaling devices 100, 101 during the movement of the sliding element 120 from the rest to the pulled position, and for keeping the levers 202 actuated when the sliding element 120 is in the pulled position and the blocking means 102 are coupled to the first movable element 101 of the locking device 100 to lock the open circuit breaker 1. In particular, the shaped portions 140 start to actuate the corresponding levers 202 of the first and second signaling devices 200, 201 after a short delay time calculated from the starting of the sliding element 120 movement, which is for instance comprised between, for example, 1 ms and 20 ms, and more preferably less than 10 ms.

The electrical signals S1 and S2 and the electrical signals S3, S4 (if present) outputted by the first and second signaling devices 200, 201 are transmitted to the outside of the locking device 100 through cables 402. As schematically shown in FIG. 9, the first and second signaling devices 200, 201 are, for example, connected to the monitor and/or control location 300, which in particular is a location 300 remote with respect to the circuit breaker 1, so as to transmit the outputted signals S1, S2 and the outputted signals S3, S4) to such a location 300 for monitoring and/or controlling by remote the actuation of the locking device 100 and/or the locked or unlocked status of the circuit breaker 1.

Further, the first and second signaling devices 200, 201 can be connected to one or more electronic devices and/or accessories of the circuit breaker 1, so as to transmit the electrical signals S1 and S2 to such electronic devices and/or accessories. In the exemplary embodiment of FIG. 9, the first signaling device 200 is operatively connected to the MOE 30 of the circuit breaker 1 so as to disable such MOE 30 by means of the outputted electrical signal S1, and the second signaling device 201 is operatively connected to the UVR 31 of the circuit breaker 1 so as to cause the fall of the power supplied to the UVR 31 below the predetermined threshold of intervention by means of the outputted electrical signal S2.

For example, the first and second electrical signals S1, S2 disable the power supply provided to the MOE 30 and to the UVR 31, respectively, by interrupting the power delivery in the power supply circuits associated to the MOE 30 and to the UVR 31. In particular, the first and second signals S1, S2 switch off one or more electronic switches, such as for example, MOS transistors, provided in the power supply circuit of the MOE 30 and of the UVR 31, respectively.

Alternatively to the exemplary embodiments shown, the locking device 100 may comprise a number of signaling devices 200, 201 which is different from the illustrated one; for example, the locking device 100 of FIG. 9 may include only the first signaling device 200 or the second signaling device 201 whose outputted electrical signal S1 or S2 is used for disabling the MOE 31 and for causing at the same time the intervention of the UVR 31.

The operation of the locking device 100 according to the present disclosure is described in the following description by making reference to the exemplary embodiments illustrated in FIGS. 1-9.

Starting from the situation in which the circuit breaker 1 is closed, the movable contacts 3 are coupled to the corresponding fixed contacts 4 and the lever 101 is in the first position, illustrated, for example, in FIG. 7. The locking device 100 is in its rest configuration and therefore the rotating shaft 11 is free to rotate about the axis of rotation 20 when actuated by the kinematic chain of the driving mechanism 10 to open the circuit breaker 1.

While the locking device 100 is in the rest configuration, the sliding element 120 remains in the rest position and the first and second signaling devices 200, 201 of FIGS. 7-8 do not output any electrical signal, while the first and second signaling devices 200, 201 of FIGS. 4-5 output the electrical signal S3 and the electrical signal S4, respectively, which are indicative of the rest configuration of the locking device 100 itself and which are transmitted to the outside of the locking device 100 through the cables 402, such as to the remote monitor and/or control location 300 (see FIG. 9).

An operator can attempt to lock the circuit breaker 1 through the actuation of the locking device 100 by gripping the shaped portion 122 and pulling the sliding element 120 from the rest position to the pulled position (see, for example, FIG. 5 or FIG. 7), in which the second through hole 151 of the sliding element 120 is aligned with the third through hole 152 of the mounting plate 109.

After a short delay time, e.g., less than 10 ms from the starting of the movement of the sliding element 120, the portions 140 of the sliding element 120 itself start actuating the levers 202 of the first and second signaling devices 200, 201 which consequently start outputting the first electrical signal S1 and the second electrical signal S2, respectively, which are indicative of at least the actuation of locking device 100 and are transmitted to the outside of the locking device 100 itself through the cables 402, such as at least to the monitor and/or control remote location 300 (see FIG. 9).

Before the actuation of the locking device 100, the circuit breaker 1 may have been already open, for example, due to the intervention of the protection devices of the circuit breaker 1 itself against an electric fault or failure, or due to the manual intervention of the operator pushing the button 12 "OFF", "O". In such situation, the rotating shaft 11 has rotated about the axis 20 to move the contacts 3 from the closed to the open position and to move the coupled lever 101 from the first position (see FIG. 7) to the second position (see FIG. 8). The first through hole 150 of the second arm 104 of the lever 101 is aligned with the third through hole 152 of the mounting plate 109 and with the second through hole 151 of the sliding element 120 when it is in the pulled position.

The actuation of the locking device 100 may dangerously start when the circuit breaker 1 is still closed. According to the exemplary embodiment of FIG. 9, the electrical signal S2 outputted by the second signaling device 201 is transmitted to the power supply circuit of the UVR 31 to interrupt the supply path and causing the fall of the supplied voltage below the intervention threshold. Therefore, the closed circuit breaker 1 is open by the intervention of the UVR 31, after a short delay time, e.g., less than 10 ms, from the starting of the movement of the pulled sliding element 120. The outputting of the electrical signal S2 guarantees a prompt opening of the circuit breaker 1 and improves the safety of the operators.

When the circuit breaker 1 is open and the sliding element 120 is in the pulled position, the operator can insert the blocking means 102 such as a padlock 108 or the crimp-configured portion 160 illustrated in FIG. 1 through the overall through hole defined by the aligned through holes 150, 151 and 152. In this way the locking device 100 is in its operative configuration in which the lever 101 and the coupled rotating shaft 11 are constrained by the blocking means 102 to the mounting plate 109, and therefore to the case of the circuit breaker 1. Hence, the circuit breaker 1 is locked, preventing any re-closure attempt of the circuit breaker 1 itself by means of manually actuation pushing the button 13, "ON" or "I" or by means of one or more closure actuators 30 of the circuit breaker 1. While the locking device 100 is kept in its operative configuration by the blocking means 102, the levers 202 of the first and second signaling devices 200, 201 are kept operated by the corresponding portions 140 of the sliding element 120, so as the respective electrical signals S1, S2 are continuously outputted for signaling such operative configuration of the locking device 100.

The electrical signal S2 may not be correctly outputted or transmitted to the UVR 31; further, alternatively to the embodiment illustrated in FIG. 9, neither the first signaling device 200 nor the second signaling devices 201 may be connected to the UVR 31. Anyway, in such conditions the covering portion 131 of the first arm 103 of the lever 101 in the first position covers the third through hole 152 of the mounting plate 109 and the second through hole 152 of the sliding element 120 in the pulled position. In this way is prevented the coupling of the blocking means 102 to the lever 101 through the insertion in the aligned through holes 150, 151, 152. Therefore, the locking of the closed circuit breaker 1 is prevented, which would avoid the open of the circuit breaker 1 at the occurrence of electric faults or failures.

According to the exemplary embodiment shown in FIG. 9, the electrical signal S1 outputted by the first signaling device 200 is transmitted to the power supply circuit of the MOE 30 to interrupt the supply path and causing the disabling of the MOE 30. Therefore, while the lever 202 of the first signaling device 200 is operated for outputting the electrical signal S1 the MOE 30 is prevented to attempt the re-closure of the open locked circuit breaker 1, which may cause damages of one or more parts of the circuit breaker 1 and/or the locking device 100 and/or the MOE 30 itself.

When the blocking means 102 are removed from the aligned through holes 150, 151, 152, the sliding element 120 is recalled from the pulled to the rest position by the biasing spring 130, so as the locking device 100 returns in its rest configuration wherein the lever 101 and the coupled rotating shaft 11 are free again to rotate about the axis 20, allowing the re-closure of the switching device 1.

The levers 202 of the first and second signaling devices 200, 201 stop to be actuated by the corresponding portions 140 a short time before (e.g., less than 10 ms) the sliding element 120 reaches the rest position. As a consequence, the outputting of the respective electrical signals S1, S2 is stopped and therefore the power supply path of the MOE 30 and the UVR are automatically restored so as the MOE 30 is re-enabled for causing the closure and/or the aperture of the circuit breaker 1, and the UVR is re-enabled for causing the opening of the circuit breaker 1.

Such results are achieved thanks to a solution which in principle makes the circuit breaker 1 according to the present disclosure easy to be used in connection with a power distribution system and/or a wind power generation plant.

Figure 10:
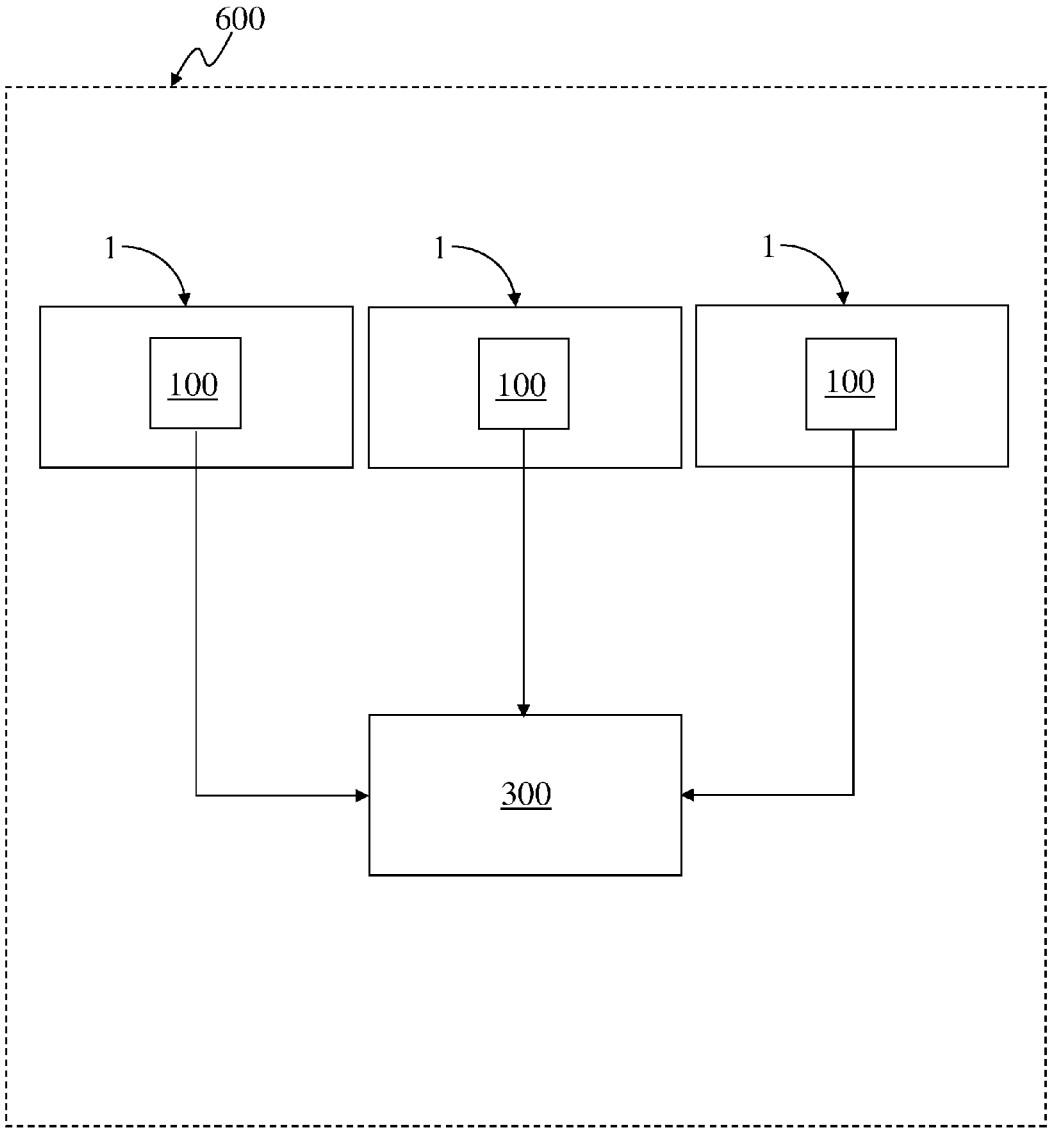
FIG. 10 is a block diagram schematically representing a power distribution system equipped with a plurality of switching devices in accordance with an exemplary embodiment of the present disclosure.

Hence, the present disclosure also encompasses a power distribution system 600 (see, for example, FIG. 10) comprising one or more circuit breakers 1 each having at least one locking device 100 according to the present disclosure. The power distribution system 600 comprises at least a monitor and/or control location 300, or station 300, which is placed remote with respect to the one or more circuit breakers 1, wherein each of the locking devices 100 of the circuit breakers 1 is connected to the remote monitor and/or control station 300 so as to transmit thereto one or more electrical signals S1, S2 which are indicative of at least one of the rest configuration, the operative configuration, and an under actuation condition of the locking device 100, i.e., the locking device 100 is moving between such rest and operative configurations.

Further, the present disclosure encompasses a wind power generation plant including the power distribution system or at least one circuit breaker 1.

In practice, it has been seen how the switching device 1 according to the present disclosure allows achieving the intended object offering some improvements over known solutions.

In particular, the locking device 100 according to the present disclosure is able to generate electrical information relative to the actuation of the locking device and/or to the locked status and/or the unlocked status of the circuit breaker 1.

Such electrical information is suitable for being transmitted and used for monitoring and/or controlling even remotely. This effect is particularly advantageous when the circuit breaker 1 and the related locking device 100 are placed in non easy accessible locations or in different and distant locations inside the power distribution system 600. For example, the power distribution system 600 may be provided in a wind power generation plant, wherein one or more circuit breakers 1 are placed at the wind towers.

The monitoring and/or controlling by remote of the locked and/or unlocked status of the circuit breaker 1 is provided in a simple and economic way by means of the locking device 100 according to the present disclosure, and improves the functionalities of the power distribution system 600 and the employment of the operators in such a system 600.

Further, the electrical signals S1, S2 outputted by the locking device 100 may be advantageously used for automatically disabling the closure actuators 30 and/or for causing the intervention of the opening actuators 31 for opening the circuit breaker 1.

Moreover, all parts/components can be replaced with other technically equivalent elements; in practice, the type of materials, and the dimensions, can be any according to needs and to the state of the art.

For example, the lever 101 can be replaced by an element mounted in a movable way on the mounting plate 109 so as to rotate between a first position and a second position; the cover 500 coupled to the mounting plate 109 may be suitable for covering the lever 101 and also the overall mounting plate 109.

Further, the lever 101 and/or the sliding element 120 and/or the cover 500 may be made of plastic materials, such as, for example, polyester.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A switching device for an electric circuit, comprising:

at least one contact movable between a closed position in which the at least one movable contact is coupled to a corresponding fixed contact and an open position in which the at least one movable contact is spaced away from said corresponding fixed contact; and at least one locking device configured for being actuated between a rest configuration in which said at least one movable contact is free to move and an operative configuration in which the at least one locking device locks said at least one movable contact in the open position; and a driving mechanism operatively connected to said at least one movable contact to cause the movement of said at least one movable contact between open and closed positions, wherein the at least one locking device is configured for outputting one or more electrical signals which are indicative of at least one of the rest configuration, the operative configuration, and an under actuation condition wherein the at least one locking device is moving between said rest and operative configurations, the at least one locking device comprising:

a first movable element operatively connected to one or more parts of said driving mechanism so as to be movable between a first position corresponding to the closed position of said at least one movable contact, and a second position corresponding to the open position of said at least one movable contact;

blocking means configured for operatively interacting with said first movable element in the second position, so as to block the first movable element in said second position; and a second movable element which is movable between a rest position and an actuated position, wherein said second movable element being configured to prevent the blocking of the first movable element by said blocking means when the second movable element is in the rest position, and to enable the blocking of the first movable element by said blocking means when the second movable element is in the actuated position.

2. The switching device according to claim 1, comprising:

at least one opening actuator configured to intervene for causing a movement of said at least one movable contact from the closed position to the open position, said at least one locking device being operatively connected to said at least one opening actuator to cause the intervention of the opening actuator for causing the movement of said at least one movable contact by means of at least one electrical signal which is indicative of at least one of the under actuation condition and the operative configuration of the at least one locking device.

3. The switching device according to claim 1, wherein when the at least one locking device is moving between said rest and operative configurations, the at least one locking device is configured for outputting the electrical signal indicative of the under actuation condition.

4. The switching device according to claim 1, wherein said locking device comprises a cover suitable for covering one or more parts of at least the first movable element.

5. The switching device according to claim 1, comprising:

at least one closure actuator suitable for causing movement of said at least one movable contact from the open position to the closed position, said locking device being operatively connected to said at least one closure actuator so as to disable the closure actuator by means of at least one electrical signal indicative of at least one of the under actuation condition and the operative configuration of the at least one locking device.

6. The switching device according to claim 5, comprising:

at least one opening actuator suitable configured to intervene four causing a movement of said at least one movable contact from the closed position to the open position, said at least one locking device being operatively connected to said at least one opening actuator to cause the intervention of the opening actuator for causing the movement of said at least one movable contact by means of at least one electrical signal which is indicative of at least one of the under actuation condition and the operative configuration of the at least one locking device.

7. The switching device according to claim 5, wherein said at least one locking device comprises:

at least one signaling device configured for receiving a first electrical signal and outputting said first electrical signal during operation, wherein said signaling device is configured for operatively interacting with one or more parts of the at least one locking device so as to be operated by said one or more parts when the at least one locking device is at least one of under actuation and in the operative configuration.

8. The switching device according to claim 1, wherein said at least one locking device comprises:

at least one signaling device configured for receiving a first electrical signal and outputting said first electrical signal during operation, wherein said signaling device is configured for operatively interacting with one or more parts of the at least one locking device so as to be operated by said one or more parts when the at least one locking device is at least one of under actuation and in the operative configuration.

9. The switching device according to claim 8, wherein said at least one signaling device is configured for receiving a second electrical signal which is different with respect to said first electrical signal, and wherein said at least one signaling device is configured for outputting said second electrical signal when said at least one signaling device is not under operation by said one or more parts of the at least one locking device.

10. The switching device according to claim 8, wherein said at least one signaling device comprises:

a first signaling device operatively connected to said closure actuator to disable the closure actuator by means of the first electrical signal outputted by the first signaling device, and a second signaling device operatively connected to said opening actuator to cause the opening actuator to intervene for causing the movement of said at least one movable contact by means of the first electrical signal outputted by the second signaling device.

11. The switching device according to claim 1, wherein said at least one signaling device comprises one or more signaling devices each configured for operatively interacting with said second movable element so as to be operated by said second movable element at least when the second movable element is in the actuated position.

12. The switching device according to claim 11, wherein said second movable element is configured for starting to operate said one or more signaling devices during movement of the said second movable element from the rest position to the actuated position.

13. The switching device according to claim 1, wherein at least a first through hole and a second through hole are defined across said first movable element and across said second movable element, respectively, and wherein said first and second movable elements, are configured so as the first through hole and the second thorough hole are aligned with each other for insertion therethrough of at least a portion of said blocking means when the first movable element is in the second position and the second movable element is in the actuated position.

14. The switching device according to claim 13, wherein said first movable element comprises a lever having at least a first arm and a second arm, wherein the first arm comprises a covering portion suitable for covering the second through hole of the second movable element in the actuated position when the lever is in the first position, and wherein said first through hole is defined across the second arm so as to be aligned with the second through hole of the second movable element in the actuated position when the lever is in the second position.

15. The switching device according to claim 13, wherein said second movable element has a portion shaped for covering said covering portion of the first arm when the lever is in the first position and the second movable element is in the rest position.

16. The switching device according to claim 1, wherein said driving mechanism comprises a main rotating shaft suitable for rotating about an axis and operatively connected to said at least one movable contact to cause with its rotation the movement of the movable contact between the open and closed positions, wherein the at least one locking device has one or more parts coupled thereto and is configured for directly acting on said rotating shaft and locking said at least one movable contact in the open position when the at least one locking device is in an operative configuration.

17. The switching device according to claim 16, wherein ends of said main rotating shaft are operatively coupled to flanks of said switching device, wherein at least one end of the main rotating shaft is accessible from outside of the switching device through an opening defined in the corresponding flank, and wherein said first movable element of the at least one locking device being coupled to said accessible end.

18. The switching device according to claim 17, wherein the at least one locking device comprises:

a mounting plate coupled to the flank of the switching device from which said end of the main rotating shaft is accessible through said opening, said mounting plate having first and second opposite faces, wherein said first movable element is mounted on said first face and said second movable element is mounted on said second face, and wherein a third through hole is defined across the mounting plate between the first and second faces, in such a way to be aligned with the first through hole and the second through hole for insertion therethrough of said at least one portion of the blocking means when the first movable element is in the second position and the second movable element is in the actuated position.

19. A power distribution system comprising:

at least one switching device according to claim 1; and at least one of a monitor and control station located remote to said at least one switching device, wherein said at least one locking device of the switching device is connected to at least one of said monitor and control station so as to transmit to at least one of the monitor and control station said one or more electrical signals.

20. A wind power generation plant comprising:

one of the power distribution system according to claim 19 or a switching device according to claim 1.

* * * * *